US005947138A

United States Patent [19]

DeAngelis

[11] Patent Number: 5,947,138

[45] Date of Patent: Sep. 7, 1999

[54] GOLF BAG UMBRELLA

[76] Inventor: Paul E. DeAngelis, 332 Country Club Rd., Washington, Pa. 15301

[21] Appl. No.: 08/936,326

[22] Filed: Sep. 24, 1997

[51] Int. Cl.[6] ..... A45B 3/00

[52] U.S. Cl. ..... 135/16; 135/19; 135/25.1

[58] Field of Search ..... 135/15.1, 16, 19, 135/20.1, 20.3, 25.1, 25.4, 98, 118; 248/511, 514, 314, 316.2, 309.1, 534; 206/315.3, 315.4; 224/915

[56] References Cited

U.S. PATENT DOCUMENTS

| | | | |
|---|---|---|---|
| 4,522,300 | 6/1985 | Hamblet | 206/315.4 |
| 4,788,996 | 12/1988 | Forshee . | |
| 4,832,362 | 5/1989 | Chen . | |
| 5,040,763 | 8/1991 | Wilson . | |
| 5,141,010 | 8/1992 | Muller et al. | 135/20.3 |
| 5,277,211 | 1/1994 | Hendershot | 135/16 |
| 5,297,570 | 3/1994 | Conner | 135/16 |
| 5,431,364 | 7/1995 | Etter | 135/16 X |
| 5,617,888 | 4/1997 | Wu | 135/20.3 |
| 5,673,718 | 10/1997 | Kennedy | 135/16 |
| 5,711,331 | 1/1998 | Harris | 135/16 |

*Primary Examiner*—Beth A. Aubrey
*Attorney, Agent, or Firm*—Webb Ziesenheim Logsdon Orkin Hanson, P.C.

[57] ABSTRACT

A golf bag umbrella is provided having an umbrella shaft with a first and second end. An umbrella canopy is carried on the umbrella shaft. A tripod assembly, having a plurality of length-adjustable legs, is attached to the second end of the umbrella shaft. Each tripod leg includes a mounting element configured to engage the rim or divider of a golf bag to hold the umbrella on the golf bag.

15 Claims, 4 Drawing Sheets

GOLF BAG UMBRELLA

BACKGROUND OF THE INVENTION

1. Field of the Invention

This invention relates generally to the field of golf bag umbrellas and, more particularly, to a golf bag umbrella which can be attached to the top of a golf bag without requiring modification of the golf bag.

2. Description of the Prior Art

In playing golf, it is important to protect the clubs in a golf bag from getting wet during periods of rain. Should the clubs become wet, the club grips may become slippery, thereby severely detracting from the player's game. Additionally, with older "woods", it is important to keep the club head as dry as possible to prevent damage to the club head.

In order to meet the needs of golf players in keeping their clubs dry, numerous golf bag umbrellas have been developed. Examples include U.S. Pat. No. 5,297,570 to Conner which discloses a golf bag umbrella having a shaft extending through a loop mounted on a divider wall of the golf bag. The shaft of the umbrella extends into the golf bag, with the bottom of the umbrella shaft resting on the floor of the golf bag.

U.S. Pat. No. 5,277,211 to Hendershot discloses a golf bag umbrella which is mounted to the exterior of a golf bag by spring clips or clamps longitudinally spaced along the golf bag.

U.S. Pat. No. 4,522,300 to Hamblet discloses a golf bag umbrella which is carried in a tube attached to the golf bag.

Generally speaking, the prior art golf bag umbrellas have several disadvantages. For example, many of the prior golf bag umbrellas are only usable with golf bags that have been modified in some way, such as the addition of special clamps, loops or tubes placed on the golf bag. Thus, a golf bag umbrella designed for one type of golf bag may not be usable with another type of golf bag. Additionally, none of the known prior art golf bag umbrellas can provide effective protection when used on both riding carts and pull carts. Further, many of these golf bag umbrellas extend into the interior of the golf bag taking up room that could be used for clubs and also making it difficult to select a club from the bag when the umbrella is in place. Some of these umbrellas are configured such that the shaft extends into, and is vertically held in, a club holding tube in the golf bag. However, most less expensive golf bags do not have such tube structures. Additionally, these prior art golf bag umbrellas are typically long and unwieldy making transport and storage difficult. Further, since many of the umbrellas have to be clamped into specially designed clamps or tubes on the golf bag, the umbrellas are not universally adaptable to different golf bags or to use on both pull carts and golf riding carts. Thus, should a player change golf bags or play with a pull cart, the golf bag umbrellas of the prior art are typically useless.

Therefore, it is an object of the invention to provide a compact, easy to transport and store golf bag umbrella. It is further an object of the invention to provide a golf bag umbrella for which no modification of the golf bag is necessary to mount the umbrella to the golf bag. It is also an object of the invention to provide a golf bag umbrella that does not extend into the interior of the bag and therefore does not decrease the space available for clubs or interfere with club selection. It is additionally an object of the invention to provide a golf bag umbrella which may be quickly and easily adapted for use on a pull cart.

SUMMARY OF THE INVENTION

A golf bag umbrella is provided having an umbrella shaft with a first and second end. An umbrella canopy is carried on the umbrella shaft. A tripod assembly, having a plurality of length-adjustable, preferably telescoping legs, is attached to the second end of the umbrella shaft. Each tripod leg includes a mounting element configured to engage the rim or divider of a golf bag to hold the umbrella on the golf bag.

In the first embodiment of the invention, the umbrella shaft has a first shaft member and a second shaft member, with a pivot assembly located between the first and second shaft members. The pivot assembly permits pivotal movement of the first shaft member with respect to the second shaft member. A locking member is selectively movable between a first position, permitting pivotal movement of the first shaft member, and a second position, in which the locking member prevents pivotal movement of the first shaft member. In another embodiment of the invention, the umbrella shaft itself is made of resilient material to permit the umbrella shaft to bend under pressure.

A complete understanding of the invention will be obtained from the following description when taken in connection with the accompanying drawings wherein like reference characters identify like parts throughout.

DESCRIPTION OF THE PREFERRED EMBODIMENTS

Figure 1:
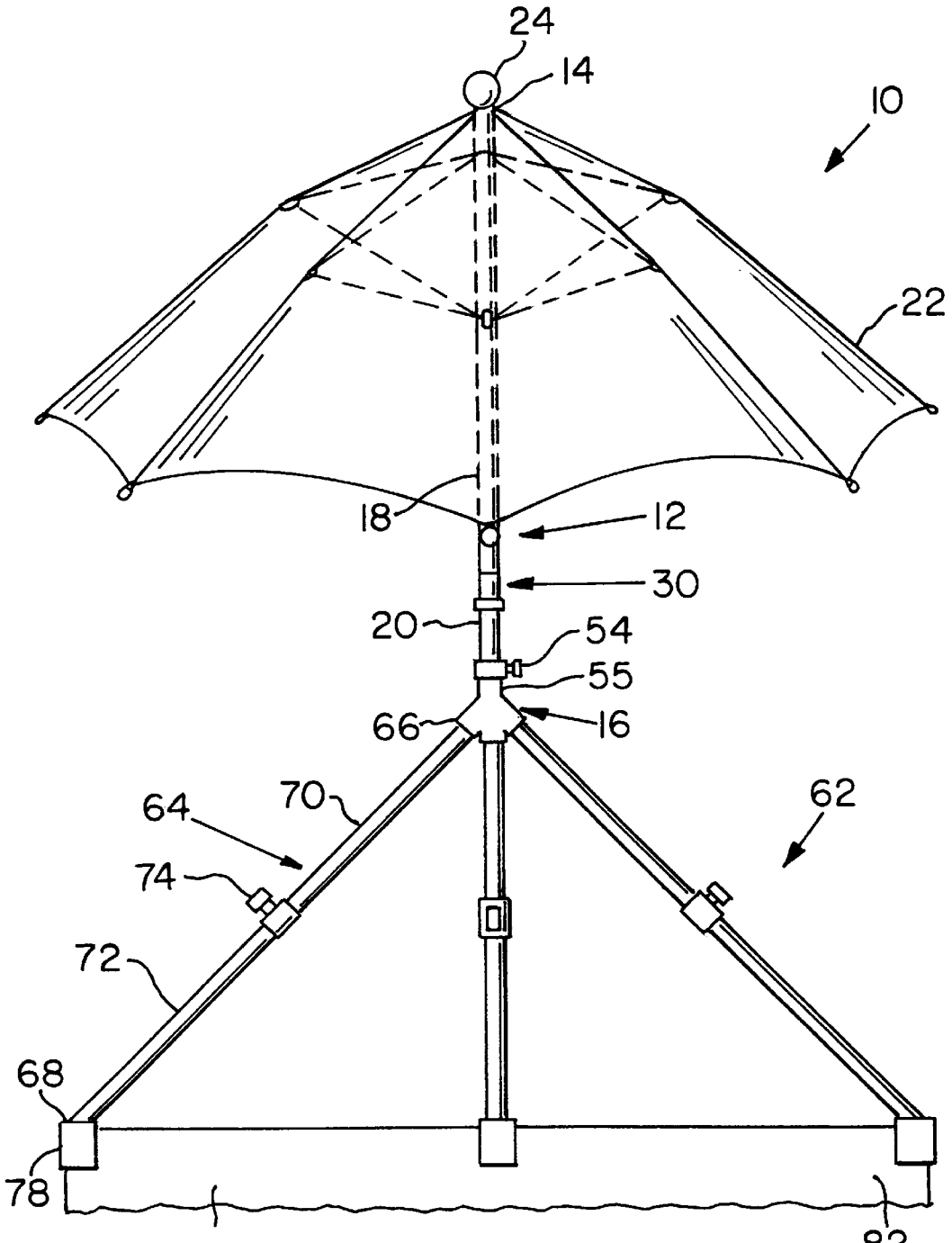
FIG. 1 is a side view of a golf bag umbrella of the invention attached to the top of a golf bag.

For purposes of the description hereinafter, the terms "upper", "lower", "right", "left", "vertical", "horizontal", "top", "bottom" and derivatives thereof shall relate to the invention as it is oriented in the drawings herein. However, it is to be understood that the invention may assume various alternative orientations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

A golf bag umbrella according to the invention is generally designated 10 in FIG. 1 of the drawings. The golf bag umbrella 10 includes an umbrella shaft 12 having a first end 14 and a second end 16. The umbrella shaft 12 is preferably formed by a first shaft member 18 and a second shaft member 20. An umbrella canopy 22 is mounted on the first shaft member 18 and is movable between an opened and a closed position in conventional manner. The construction and operation of such an umbrella canopy 22 is well-known to one of ordinary skill in the art and is therefore not discussed in detail herein. A final 24 is mounted on the top of the first shaft member 18.

Figure 2:
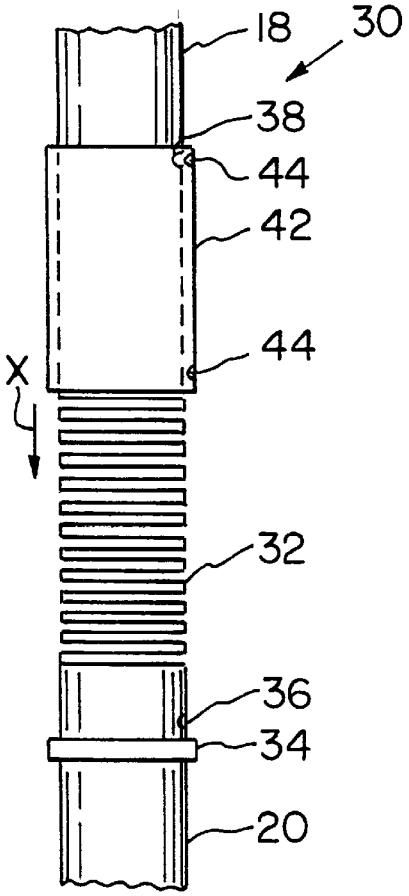
FIG. 2 is a side view of a first pivot assembly for the golf bag umbrella shown in FIG. 1.

A pivot assembly 30 is positioned between the first and second shaft members 18, 20 such that the first shaft member 18 is movable relative to the second shaft member 20. A first embodiment of the pivot assembly 30 is shown in FIG. 2 of the drawings. In this embodiment, a resilient member 32, such as a coil spring, is attached to and extends between the first and second shaft members 18 and 20. A stop 34, such as an annular ledge, is formed on the second shaft member 20 adjacent the resilient member 32. A first engagement element 36, such as a depression or dimple, is formed on the second shaft member 20 between the stop 34 and the resilient member 32.

A second engagement element 38, similar to the first engagement element 36, is formed on the first shaft member 18. A locking member 42, such as a cylindrical sleeve, is slidable along the first and second shaft members 18 and 20 and the resilient member 32. A pair of engagement members 44, such as nipples, are formed on the locking member 42 and are configured to engage the engagement elements 36 and 38 on the first and second shaft members 18 and 20. The locking member 42 is configured to move from a first position, shown in FIG. 2 of the drawings, in which the locking member 42 is held on the first shaft member 18 by engagement of the upper engagement member 44 with the engagement element 38 on the first shaft member 18. In this configuration, the resilient member 32 is not confined in any way and thus the first shaft member 18 is freely movable relative to the second shaft member 20.

The locking member 42 is movable in the direction of arrow X from the first position to a second position in which the lower end of the locking member 42 abuts the top surface of the stop 34 on the second shaft member 20 and the lower engagement member 44 of the locking member 42 engages the engagement element 36 of the second shaft member 20. In this position, the locking member 42 surrounds the resilient member 32, thereby preventing movement of the first shaft member 18 with respect to the second shaft member 20.

Figure 3:
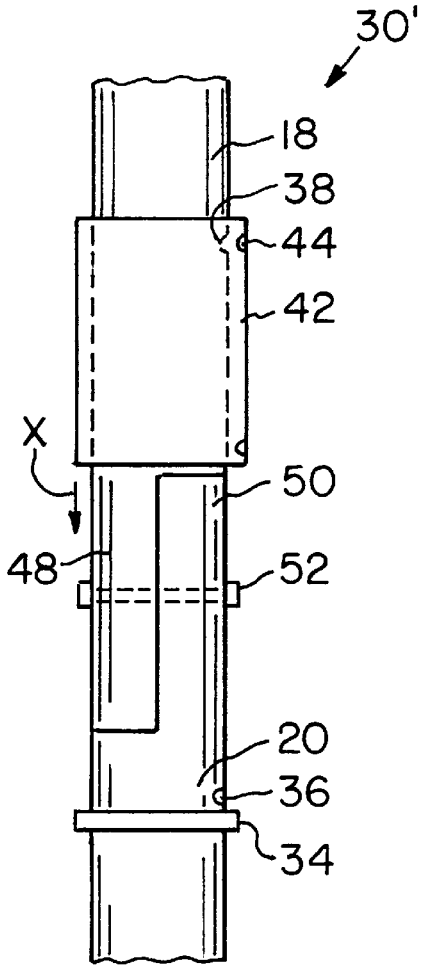
FIG. 3 is a side view of a second pivot assembly for the golf bag umbrella shown in FIG. 1.

An alternative embodiment of the pivot assembly is designated 30' in FIG. 3 of the drawings. In this embodiment, a first arm 48 is formed on the first shaft member 18 and a complementary, second arm 50 is formed on the second shaft member 20. A pivot element 52, such as a pivot pin, extends through the arms 48 and 50. Thus, the arms 48 and 50 are movable in conventional "scissors-type" manner so that the first shaft member 18 is movable with respect to the second shaft member 20. The structure of the stop 34 and the locking member 42 are the same as described above with respect to the embodiment shown in FIG. 2 of the drawings. The locking member 42 is reversibly movable in the direction of arrow X between a first position, shown in FIG. 3 of the drawings, in which the locking member 42 is carried on the first shaft member 18 to a second position (shown in FIG. 1) in which the lower end of the locking member 42 abuts the stop 34 such that the locking member 42 surrounds the arms 48 and 50 thus preventing pivotal movement between the first shaft member 18 and the second shaft member 20.

As shown in FIG. 1 of the drawings, the length of the second shaft member 20 may be adjustable. For example, the second shaft member 20 may be a conventionally telescoping assembly having an inner member slidable within an outer member to adjust the length of the second shaft member 20. In this case, a shaft holding element 54, such as a conventional screw and collar assembly, is positioned on a tripod neck 55 to hold the second shaft member 20 at a selected length.

A tripod assembly 62 is attached to the lower end of the second shaft member 20. The tripod assembly 62 includes three adjustable length legs 64, each having a first end 66 and a second end 68. The first end 66 of each leg 64 is hingedly connected to the bottom of the tripod neck 55. Each leg 64 is preferably formed by a first or outer leg member 70 and a second or inner leg member 72, with the second leg member 72 slidable within the first leg member 70 such that the length of the leg 64 is telescopically adjustable. A holding element 74, such as a conventional screw and collar arrangement, is mounted on the leg 64 to permit selective adjustment of the length of the leg 64. A mounting element 78, such as a conventional U-shaped spring clip, is pivotally carried on the second end 68 of each leg 64. The legs 64 are substantially equally spaced around the second shaft member 20 such that the legs 64 are spaced about 120° apart.

Figure 5:
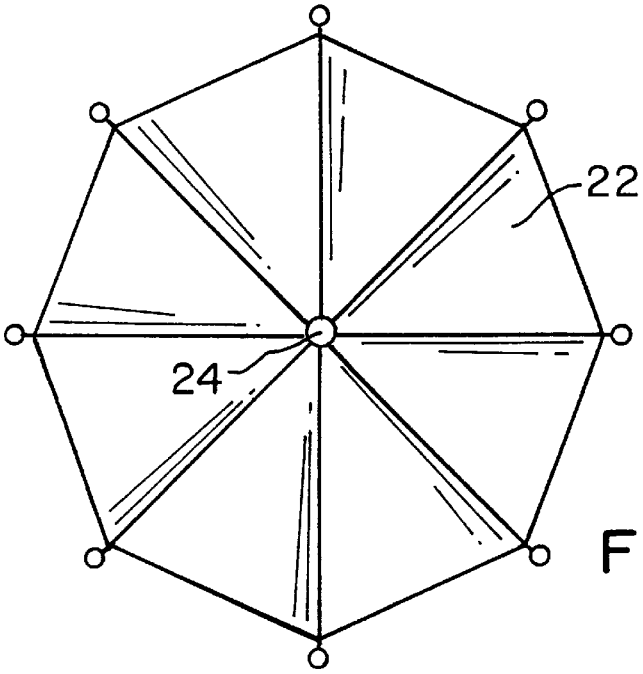
FIG. 5 is a plan view of the umbrella canopy.

A plan view of the umbrella canopy 22 is shown in FIG. 5 of the drawings. The umbrella canopy 22 is preferably made of nylon fabric and has an open diameter of about 15 inches.

Figure 4:
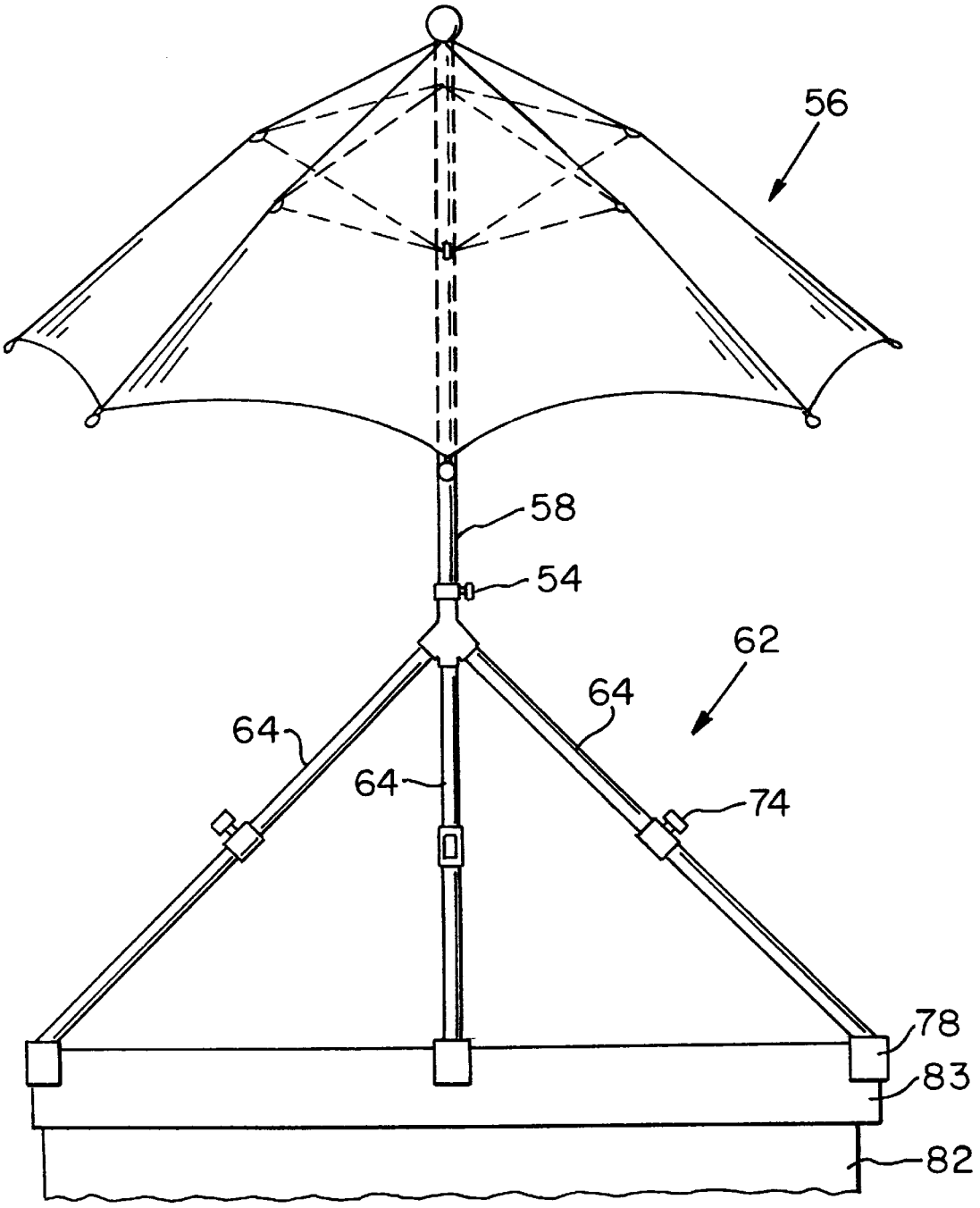
FIG. 4 is a side view of a golf bag umbrella of the invention having a modified umbrella shaft.
Figure 7:
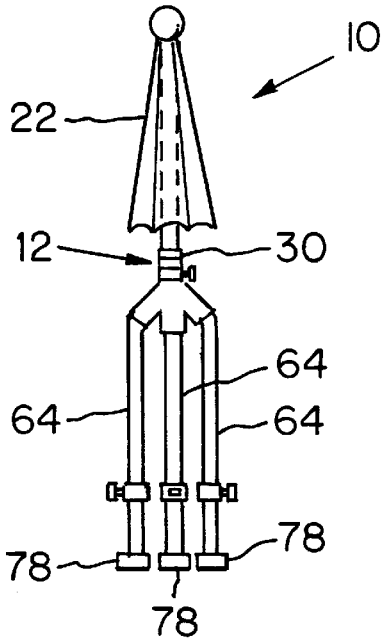
FIG. 7 is a side view of the golf bag umbrella of the invention folded for easy transport.

An alternative embodiment of the golf bag umbrella is designated 56 in FIG. 4 of the drawings. The umbrella 56 is similar to the umbrella 10 but the umbrella shaft 58 is formed from a unitary piece of flexible, resilient material, such as graphite, fiberglass or suitable plastic. Thus, the entire shaft 58 is bendable under pressure to allow the umbrella canopy to be moved, as will be described hereinbelow. The tripod assembly 62 is attached to the bottom of the shaft 58.

Operation of the golf bag umbrella 10 will now be described. Looking at FIG. 1 of the drawings, to place the umbrella 10 on a golf bag 82, the mounting elements 78 on the bottom of each leg 64 are slipped over the upper rim 83 of the golf bag 82. The U-shaped structure of the mounting elements 78 allows the mounting elements 78 to be quickly and easily attached to the golf bag rim 83. The mounting elements 78 may include a threaded screw engageable with a threaded hole in the mounting element 78 to more firmly attach the umbrella 10 to the golf bag rim, however, a spring-loaded clip is presently preferred.

The length of each leg 64, and thus the height of the umbrella canopy 22 above the top of the golf bag 82, is selectively adjustable by loosening and tightening the holding elements 74. The distance of the umbrella canopy 22 above the top of the golf bag 82 can further be adjusted by loosening and re-tightening the shaft holding element 54 and selectively adjusting the length of the second shaft member 20 or shaft 58.

To permit the first shaft member 18 to pivot with respect to the second shaft member 20, the locking member 42 is moved to the upper position shown in FIGS. 2 and 3. The locking member 42 is held in this position by engagement of the upper engagement member 44 of the locking member 42 with the engagement element 38 on the first shaft member 18. With respect to the pivot assembly 30 shown in FIG. 2 of the drawings, the umbrella canopy 22 can be moved out of the way of the player to allow for easier golf club selection by simply pushing on the first shaft member 18 to deform the resilient member 32 and allow the first shaft member 18 to bend. When the pressure is released from the first member 18, the first shaft member 18 will reversibly spring back to its previous position. If no movement of the first shaft member 18 with respect to the second shaft member 20 is desired, the locking member 42 can simply be moved from the upper position to the lower position to encircle the resilient member 32 and thus prevent movement of the first shaft member 18 with respect to the second shaft member 20. The locking member 42 is held in this second position by engagement of the lower engagement member 44 with the engagement element 36 on the second shaft member 20.

Operation of the pivot assembly 30' shown in FIG. 3 of the drawings is similar to that described above. However, with the pivot assembly structure shown in FIG. 3 of the drawings, the umbrella 10 will not automatically reset to the first position. Rather, the umbrella 10 will stay at the angle selected until another pressure is brought against the first shaft member 18.

With respect to the embodiment 56 shown in FIG. 4 of the drawings, the flexible shaft 58 can be deformed in any direction by simple pressure. The shaft 58 then immediately returns to its previous position upon release of the pressure.

Figure 6:
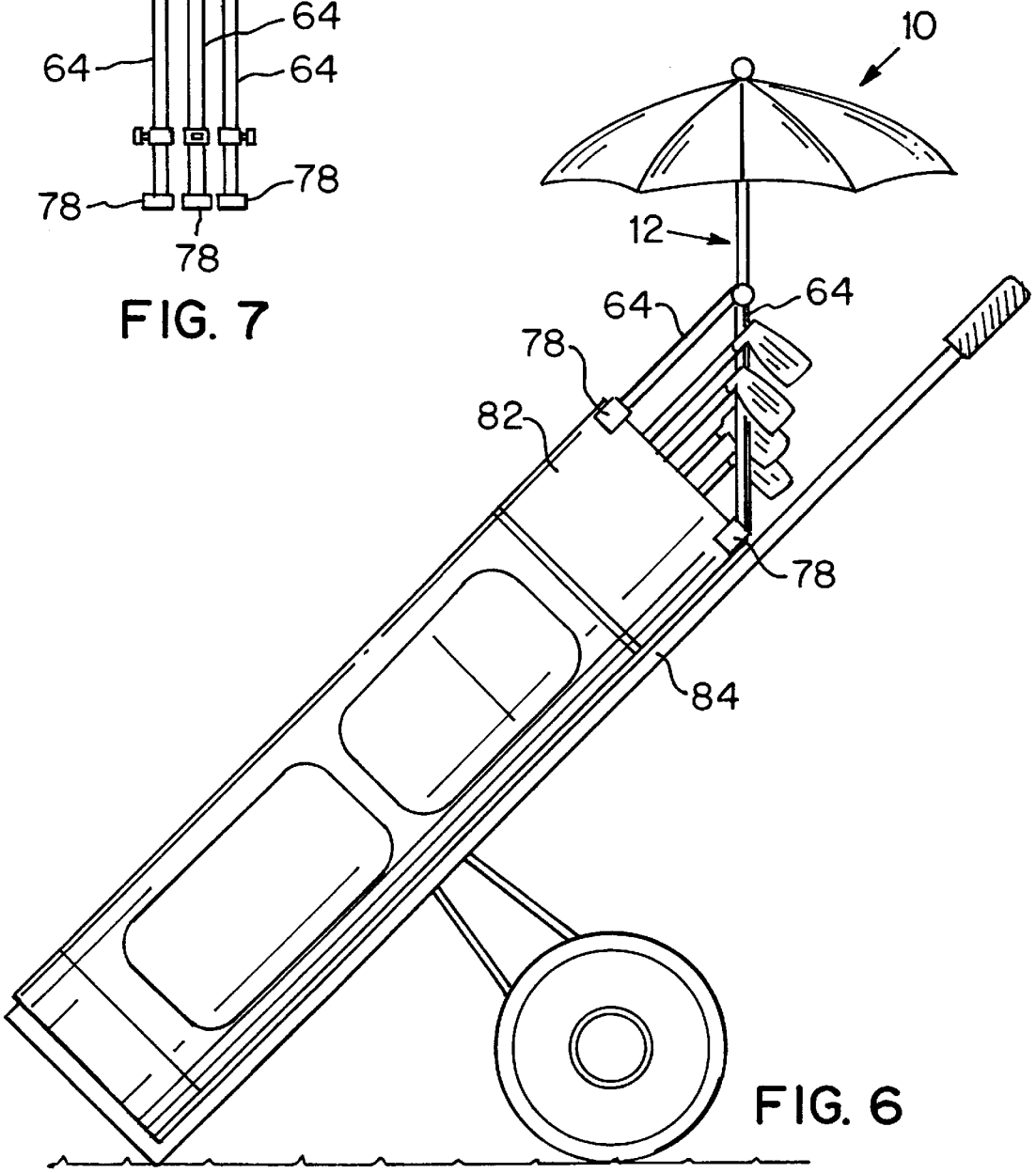
FIG. 6 is a side view of the golf bag umbrella mounted on a golf bag in a golf cart.

The attachment of the umbrella 10 to a golf bag 82 in a typical pull cart 84 is shown in FIG. 6 of the drawings. The mounting elements 78 are placed on the top rim of the golf bag 82, as described hereinabove. By selectively adjusting the length of the legs 64, the umbrella 10 can be positioned such that the umbrella canopy 22 is positioned at an angle with respect to the top of the golf bag 82 to maintain the umbrella shaft 12 substantially vertical with the ground. The golf clubs are then easily accessible by a player, while at the same time protected from the rain. However, should the player wish to move the umbrella canopy 22 to provide even more access to the interior of the golf bag 82, the player can simply use one hand to push on the first shaft member 18 to allow the first shaft member 18 to pivot with respect to the second shaft member 20, as described above.

To remove the umbrella 10 from the golf bag 82, the mounting elements 78 are removed, for example by simply sliding them from the top of the golf bag 82, and the legs 64 are telescoped to their retracted position and folded inwardly. The umbrella canopy 22 may then be retracted in conventional manner to fold around the umbrella shaft 12. With the legs 64 folded together and the umbrella canopy 22 in its folded position, the golf bag umbrella 10 of the invention is very compact and easy to transport. As will be understood from the above description, the golf bag umbrella 10 of the invention does not require modification of the golf bag in any manner whatsoever. Thus, the golf bag umbrella 10 can be used with any golf bag, regardless of size, type or manufacture. Additionally, since the golf bag umbrella 10 of the invention does not extend into the interior of the golf bag, it does not unduly restrict club position and selection.

It will readily be appreciated by those skilled in the art that modifications may be made to the invention without departing from the concepts disclosed in the foregoing description. Accordingly, the particular embodiments described in detail hereinabove are illustrative only and are not limiting as to the scope of the invention which is to be given the full breadth of the appended claims and any and all equivalents thereof.

I claim:

1. A golf bag umbrella, comprising:

an umbrella shaft having a first end and a second end;

an umbrella canopy carried on the umbrella shaft; and a tripod assembly attached to the second end of the umbrella shaft and configured to releasably engage a top of a golf bag.

2. The umbrella as claimed in claim 1, wherein the tripod assembly includes three adjustable length legs, with each leg having a first end and a second end, and a mounting element pivotally attached to the second end of each leg, with the mounting element configured to engage a top of a golf bag.

3. The umbrella as claimed in claim 1, wherein the umbrella shaft includes a first shaft member and a second shaft member with a pivot assembly located between the first and second shaft members, the pivot assembly permitting movement of the first shaft member with respect to the second shaft member.

4. The umbrella as claimed in claim 1, wherein the umbrella shaft is a flexible shaft.

5. The umbrella as claimed in claim 1, wherein the umbrella shaft is an adjustable length shaft.

6. The umbrella as claimed in claim 2, wherein each leg has a holding element configured to hold the leg at a selected length.

7. The umbrella as claimed in claim 2, wherein the legs are telescopically adjustable.

8. The umbrella as claimed in claim 3, wherein the pivot assembly includes a resilient member.

9. The umbrella as claimed in claim 3, including a locking member selectively movable from a first position in which the first shaft member is pivotable with respect to the second shaft member, and a second position in which the first shaft member is prevented from pivoting with respect to the second shaft member.

10. The umbrella as claimed in claim 3, wherein the pivot assembly includes a first arm on the first shaft member and a second arm on the second shaft member with a pivot element extending through the first and second arms and about which the first and second shaft members are pivotally movable.

11. The umbrella as claimed in claim 8, wherein the resilient member is a coil spring.

12. The umbrella as claimed in claim 9, including an engaging assembly configured to selectively hold the locking member in the first and second positions.

13. The umbrella as claimed in claim 9, including a stop formed on the second shaft member for supporting the locking member.

14. The umbrella as claimed in claim 9, wherein the locking member is a cylindrical sleeve.

15. The umbrella as claimed in claim 5, wherein the umbrella shaft is a telescopically adjustable shaft.

* * * * *

UNITED STATES PATENT AND TRADEMARK OFFICE

CERTIFICATE OF CORRECTION

PATENT NO. : 5,947,138

DATED : September 7, 1999

INVENTOR(S) : Paul E. DeAngelis

It is certified that error appears in the above-identified patent and that said Letters Patent is hereby corrected as shown below:

Column 3 Line 1 "A final 24" should read --A finial 24--.

Signed and Sealed this

Eighteenth Day of April, 2000

*Attest:*

Q. TODD DICKINSON

*Attesting Officer*

*Director of Patents and Trademarks*